United States Patent [19]

Wilson et al.

[11] Patent Number: 4,949,760

[45] Date of Patent: Aug. 21, 1990

[54] OFFSET HOOK, BALANCED CENTER SHED DOBBY APPARATUS

[75] Inventors: Arthur J. Wilson, Menlo Park; Fredrick J. Ahrens, Oakland, both of Calif.

[73] Assignees: Jeffrey Wilson; Cyrena N. Wilson, both of Menlo Park, Calif.

[21] Appl. No.: 252,736

[22] Filed: Oct. 3, 1988

[51] Int. Cl.[5] ..... D03C 1/06

[52] U.S. Cl. ..... 139/66 R; 139/29; 139/65

[58] Field of Search ..... 139/29, 66 R, 66 A, 139/67, 74, 65, 30, 31, 32, 33, 68

[56] References Cited

U.S. PATENT DOCUMENTS

| | | | |
|---|---|---|---|
| 2,136,064 | 11/1938 | Tandler et al. | 139/67 |
| 2,941,551 | 6/1960 | Ballard | 139/65 |
| 3,669,154 | 6/1972 | Horak | 139/68 X |
| 4,291,730 | 9/1981 | Kremer | 139/65 |

FOREIGN PATENT DOCUMENTS

| | | | |
|---|---|---|---|
| 449923 | 9/1925 | Fed. Rep. of Germany | 139/68 |
| 458579 | 10/1913 | France | 139/68 |

OTHER PUBLICATIONS

Fannin, *Handloom Weaving Technology,* (1979), pp. 85, 88, 89, 91, 92.

Kinzer, *Technologie der Handweberei,* (1926) pp. 107, 108, 114, 116, 118, and 121 No Translation.

*Primary Examiner*—Andrew M. Falik

*Attorney, Agent, or Firm*—Flehr, Hohbach, Test, Albritton & Herbert

[57] ABSTRACT

A dobby apparatus is provided for use with hand looms for automatically controlling the lifting sequence of a plurality of shaft assemblies in accordance with a predetermined weaving program. The dobby apparatus has a dobby operating drive mechanism connected to a dobby operating arm for pivoting the dobby operating arm downwardly from a neutral position and returning it to the neutral position during each dobby operating cycle. A plurality of dobby hook pairs are mounted in a transfer position when the dobby operating arm is in the neutral position. Each of the plurality of dobby hook pairs are connected to a different one of the plurality of shafts. A plurality of dobby hook positioner assemblies contact the dobby hook pairs to laterally transfer both of the dobby hooks in each of the pairs between capture positions in the dobby operating arm. A dobby program drive assembly in operative engagement with the dobby hook positioner assemblies controls lateral displacement of the dobby hook positioner assemblies in accordance with a predetermined weaving program. The dobby hooks of the plurality of dobby hook pairs each have two generally parallel sections connected by a terminal end and a hook portion extending from one of the parallel sections offset toward the other of the parallel sections and aligned directly beneath the parallel sections. Each of the dobby hooks are connected to one of the plurality of shafts from the terminal end.

14 Claims, 10 Drawing Sheets

OFFSET HOOK, BALANCED CENTER SHED DOBBY APPARATUS

TECHNICAL FIELD

The present invention relates to an improved dobby apparatus for use with hand looms for automatically controlling the lifting sequence of a plurality of shafts using only two treadles. The improved dobby apparatus of the present invention permits weaving of a variety of weaves incorporating intricate patterns and significantly increases weaving speed.

BACKGROUND ART

Dobby apparatus for use with hand looms are known in the art for controlling the lifting sequence of a plurality of shafts. Use of dobby apparatus permits weaving of complex patterns using, typically, eight, twelve, sixteen, twenty or twenty-four shafts. Multiple shaft dobbies requiring two treadles for each shed change, and using pegs inserted in holes of wooden dobby bars to provide the predetermined weaving pattern are commercially available. Traditional old-style multiple shaft dobbies often operated with a single, massive, hard-working treadle. Use of computerized weaving systems as a tool to create and program weaving patterns are also known in the art. Prior art dobby apparatus, however, are relatively large and unwieldy, and they typically require a substantial amount of manual effort to operate.

Accordingly, it is an objective of the present invention to provide a dobby apparatus which permits weaving of a variety of weaves and intricate patterns in accordance with a predetermined weaving program.

It is another objective of the present invention to provide a dobby apparatus which is compact and may be a retrofit on many types of existing hand looms.

It is yet another objective of the present invention to provide a dobby apparatus which is easy to operate and requires little manual effort on the part of the operator.

It is still another objective of the present invention to provide a dobby apparatus providing consistent, reliable longterm operation.

It is yet another objective of the present invention to provide a dobby apparatus wherein one complete dobby cycle is achieved with each depression and return of each treadle, providing increased weaving speed and a convenient weaving rhythm.

SUMMARY OF THE INVENTION

The dobby apparatus of the present invention controls the lifting sequence of a plurality of shafts in accordance with a predetermined weaving program. The predetermined weaving program is preferably provided as a series of punched holes on each program line of a punched paper dobby loop. Each program line on the punched paper dobby loop has a number of aligned punch positions corresponding to the number of shafts, with a punched hole in the punch position indicating the corresponding shaft is to be positioned in a lifted position, and the absence of a punched hole in the punch position indicating that the corresponding shaft is to be positioned in a lowered position. Alternatively, the predetermined weaving program may be conveyed to the dobby apparatus by direct electronic linkage to a computer having appropriate software. Computer equipment for use as a tool in generating weaving patterns is known in the art, and is commercially available.

The dobby apparatus of this invention has a dobby operating drive mechanism connected to a dobby operating arm for pivoting the dobby operating arm downwardly from a neutral position and returning it to the neutral position during each dobby operating cycle. A plurality of dobby hook pairs are mounted in a transfer position when the dobby operating arm is in the neutral position. Each of the plurality of dobby hook pairs are connected to a different one of the plurality of shafts. A plurality of dobby hook positioner assemblies contact the dobby hook pairs to laterally transfer both of the dobby hooks in each of the pairs between capture positions in the dobby operating arm. A dobby program drive assembly in operative engagement with the dobby hook positioner assemblies controls lateral displacement of the dobby hook positioner assemblies in accordance with a predetermined weaving program.

The dobby hooks of the plurality of dobby hook pairs each have two generally parallel sections connected by a terminal end and a hook portion extending from one of the parallel sections offset toward the other of the parallel sections and aligned directly beneath the parallel sections. Each of the dobby hooks are connected to one of the plurality of shafts from the terminal end. The dobby apparatus has a means for forcing the dobby hooks of the plurality of dobby hook pairs into position for clearance from the capture positions to permit transfer between the capture positions. A hook return arm is positioned to restrain ones of the hooks of the plurality of dobby hook pairs that are free of capture. Each of the dobby hook pairs is connected to one of the plurality of shafts with flexible cord. A biasing means is connected to the flexible cord to pull on the flexible cord in a direction opposite to a direction of pull by the weight of the one of said plurality of shafts on the flexible cord, thus to balance the weight of the one of said plurality of shafts. The dobby program drive assembly includes a looped member having a plurality of apertures defining the weaving program. A drive means is connected to the looped member. An indexing and position locking means is connected to the drive means. A forward and reverse control means is connected to the indexing and position locking means. A capture bar is positioned on and substantially parallel to the dobby operating arm. A biasing means is connected to the capture bar to urge the capture bar against the dobby operating arm to keep ones of the hooks in the hook pairs captured by the dobby operating arm in the captured position. A means holds the capture bar away from the dobby operating arm when the dobby operating arm is in the neutral position.

BRIEF DESCRIPTION OF THE DRAWINGS

The above-mentioned and additional features of the present invention and the manner of obtaining them will become apparent, and the invention will be best understood by reference to the following more detailed description read in conjunction with accompanying drawings, in which.

BEST MODE OF CARRYING OUT THE INVENTION

Figure 1:
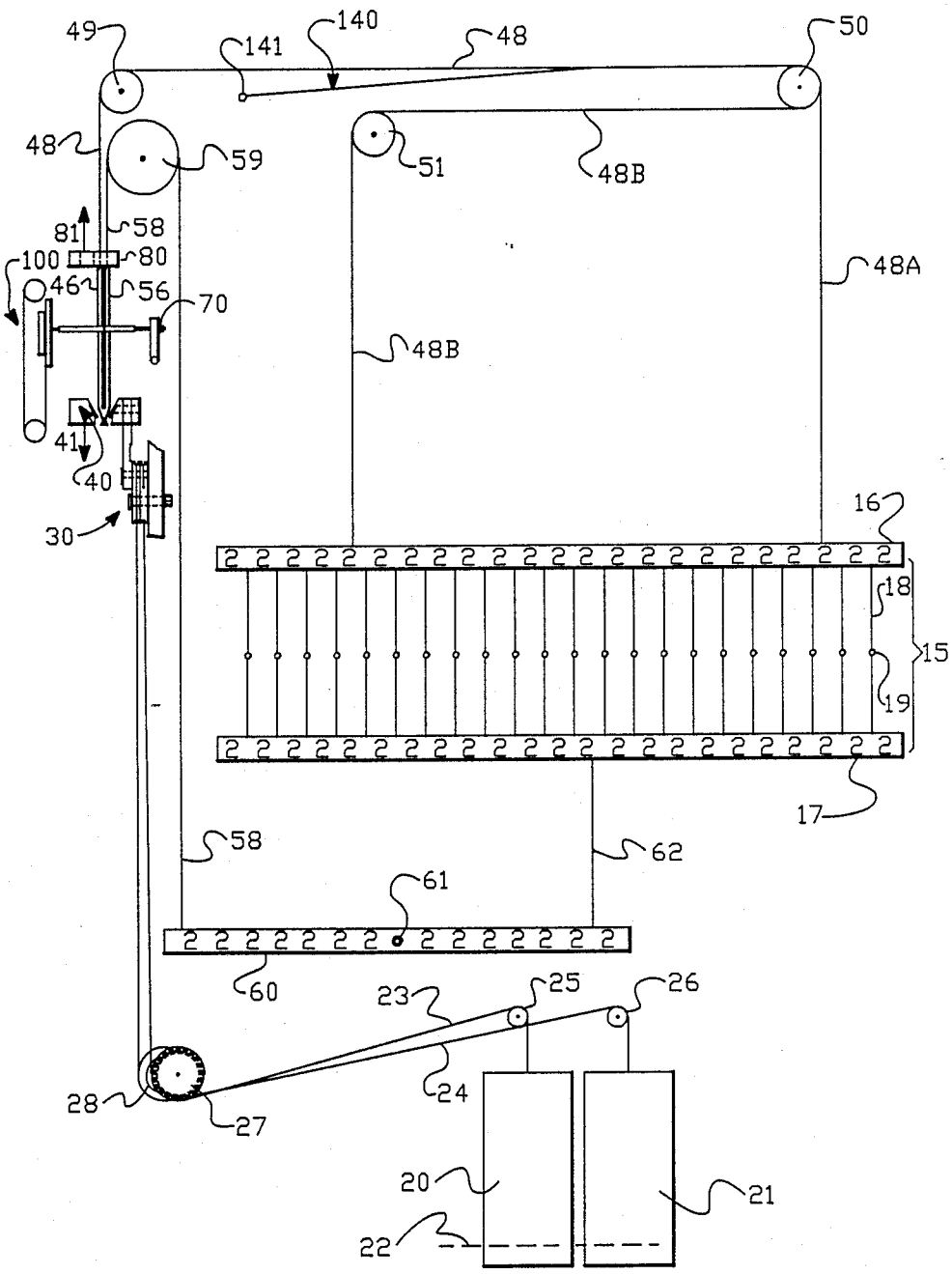
FIG. 1 shows an overall schematic view of the dobby apparatus of the present invention in the neutral position (with the shed closed) as it would appear from the front of a hand loom, illustrating the operation of the dobby apparatus with reference to a single shaft assembly.
Figure 2:
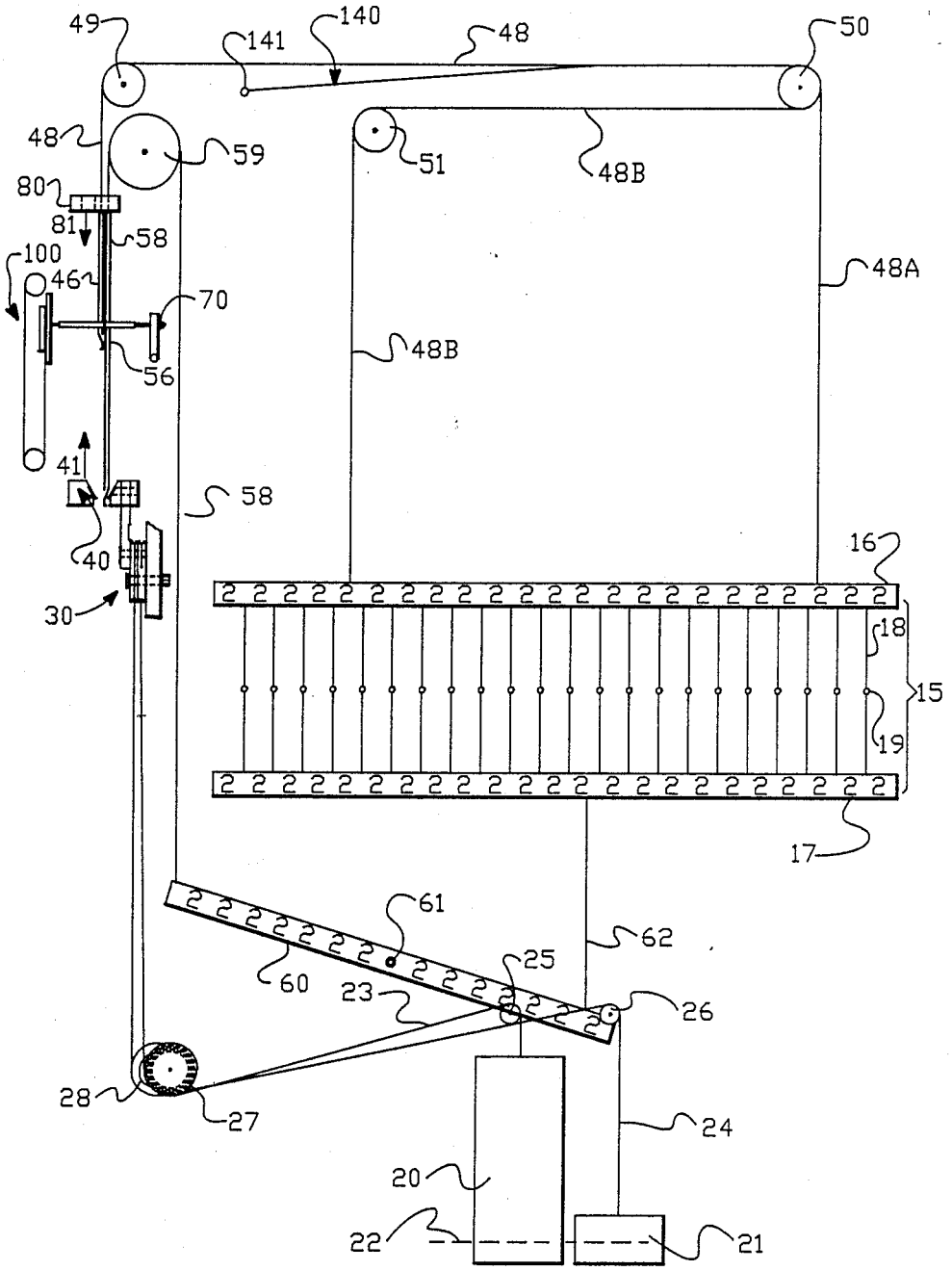
FIG. 2 shows an overall schematic view of the dobby apparatus of the present invention as it would appear from the front of a hand loom, illustrating a single shaft assembly adjusted to a lowered, open shed position.

FIGS. 1 and 2 illustrate, schematically, the overall operative principles of the dobby apparatus of the present invention with reference to a single shaft assembly. FIG. 1 shows the dobby apparatus and shaft assembly in a neutral position wherein the shafts are aligned with the centerline of the warp, while FIG. 2 shows the shaft assembly in a lowered, open shed position. The dobby apparatus of the present invention is designed for use with multiple shaft assemblies aligned adjacent to one another in close proximity, and is especially suitable for use with eight, twelve, sixteen, twenty or more shaft assemblies. For purposes of this description, the number of shaft assemblies and corresponding multiple components will be referred to as "N" shafts or components.

As shown in FIGS. 1 and 2, each shaft 15 comprises upper and lower bars 16 and 17, respectively, aligned parallel to one another. Lower bar 17 is suspended from upper bar 16 by a plurality of heddles 18 spaced at intervals along substantially the entire length of bars 16 and 17. Each heddle 18 has a heddle eye 19 at substantially its midline, and each heddle eye 19 receives a warp thread therethrough. As shaft 15 is raised or lowered from its neutral position aligned with the centerline of the warp, it raises or lowers the warp threads received in its heddle eyes. The total number of heddles 18 on N shafts corresponds to the total number of warp threads.

With each dobby operating cycle, each shaft 15 is raised or lowered from the neutral position, an open shed is provided, and each shaft is returned to the neutral position wherein heddle eyes 19 are aligned on the centerline of the warp. When the shed is in the open part of the cycle, each shaft assembly 15 is raised or lowered the same distance from the center line of the warp. The shed is therefore centered about the warp line and warp ends are stressed equally, whether the shaft moves above or below the warp line. We refer to this shed action as a balanced center shed, as contrasted with rising or sinking shed dobbies, which do not stress warp ends equally. It is an important aspect of the present invention that with each treadle stroke, the dobby apparatus undergoes a complete dobby operating cycle, providing an open shed for passage of the shuttle, and returning the shafts to their neutral position.

Operating arm 40 is lowered from its neutral position shown in FIG. 1 and returned to the neutral position by depression of treadles 20 or 21 via operating arm drive mechanism 30. During each dobby operating cycle, operating arm 40 controls the vertical position of a pair of dobby hooks 46, 56 corresponding to each shaft, which serve to raise or lower the corresponding shaft in accordance with the predetermined weaving program. During each dobby operating cycle, one of the dobby hooks in the pair is captured by and lowered with operating arm 40, and the other dobby hook in the pair is correspondingly raised. In the neutral position shown in FIG. 1, right-hand dobby hook 56 is in a capture position and will be lowered with operating arm 40.

The upper end of right-hand dobby hook 56 is attached to double cored 58, which is passed around pulley 59 and attached to one end of lamm 60 which is pivotable about its centerline at pivot point 61. As shown in FIG. 2, when right-hand dobby hook 56 is lowered with operating arm 40 during a dobby operating cycle, lamm 60 is pivoted about pivot axis 61 to raise the left-hand end and lower the right-hand end of lamm 60. Cord 62 is mounted on the end of lamm 60 opposite attachment of cord 58, and cord 62 is mounted at its other end to a central portion of lower bar 17 of shaft 15. As the right-hand end of lamm 60 is pivoted downwardly, therefore, the corresponding shaft 15 is lowered to an open shed position. The right-hand dobby hook 56 will be referred to as the sinking hook, since when it is lowered with operating arm 40, it causes the corresponding shaft to be lowered.

As operating arm 40 captures and lowers sinking hook 56 to lower the corresponding shaft, left-hand dobby hook 46 is raised by the sinking action of shaft 15. Left-hand dobby hook 46 is attached at its upper end to double cord 48 which is passed around pulley 49, across the width of the loom and around pulley 50. Double cord 48 is thereafter separated as single cords 48A and 48B. Cord 48A is attached to one end of upper bar 16, and cord 48B is passed around pulley 51 and attached to the other end of upper bar 16 of shaft 15. As shaft 15 is lowered due to capture of sinking hook 56 in operating arm 40, it thus serves to raise left-hand hook 46. Left-hand dobby hook 46 will be referred to hereinafter as the rising hook.

Conversely, when the dobby hook pair is positioned so that rising dobby hook 46 is in the capture position with respect to operating arm 40, the rising dobby hook is lowered with operating arm 40, and the corresponding shaft is positively raised to provide an open shed position. Since the shaft is positively raised as rising hook 46 is lowered, the corresponding lamm 60 is pivoted so that the right-hand side is raised and the left-hand side is lowered, which positively lifts sinking dobby hook 56. Each dobby hook pair forms part of a closed loop system whereby when one of the hooks in a pair is captured and lowered by operating arm 40, it positively raises or lowers the corresponding shaft, which positively raises the other dobby hook in the pair.

Although the dobby operating cycle has been described and illustrated with reference to a single shaft assembly, it will be recognized that the dobby apparatus of the present invention comprises N shafts arranged immediately adjacent one another; N corresponding lamms aligned immediately adjacent one another; N pairs of dobby hooks aligned adjacent one another; N sets of pulleys 49, 50, 51, and 59; and N sets of the corresponding cords required to connect the shaft assemblies.

Figure 3:
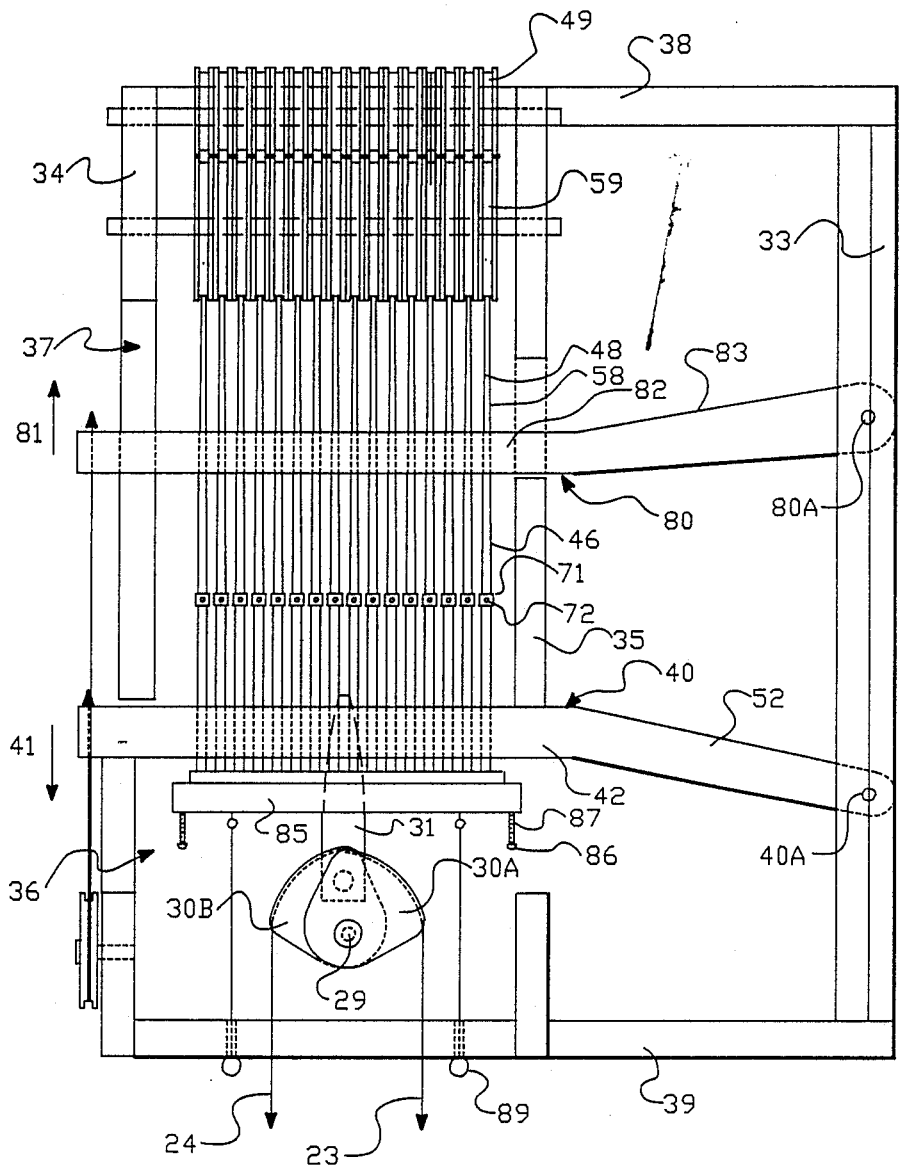
FIG. 3 shows a front view of the dobby apparatus as it would appear from the side of a hand loom, illustrating multiple pairs of dobby hooks corresponding to a sixteen shaft dobby arrangement.

The supporting framework of the dobby apparatus of the present invention has been deleted for purposes of clarity in FIGS. 1 and 2. FIG. 3 illustrates a front view of the dobby apparatus of the present invention in the neutral position as is would appear from the side of a hand loom, with dobby program drive assembly 100 deleted for purposes of clarity. The dobby supporting framework preferably includes two generally vertical supports 34 and 35 provided to enclose the dobby hook pairs, the corresponding cords, dobby operating arm drive mechanism 30, and to support dobby program drive assembly 100. Intermediate vertical support 35 is provided with clearance openings for passage of operating arm 40 and dobby hook return arm 80 as they are moved in the directions indicated by arrows 41 and 81, respectively, during the dobby operating cycle. Vertical support 34 is provided with tang guide slots 36 and 37 for guiding operating arm 40 and dobby hook return arm 80, respectively, during each dobby cycle. Top and bottom crosspieces 38 and 39, respectively, are provided joining vertical supports 34 and 35 and preferably extend beyond intermediate vertical support 35 to a location corresponding approximately to the pivot axes of operating arm 40 and dobby hook return arm 80. Vertical members 33 are preferably provided joining top and bottom crosspieces 38 and 39 at their free terminal ends and pivotally mounting operating arm 40 and dobby hook return arm 80. The dobby apparatus is preferably mounted on a hand loom so that the pivot axes of operating arm 40 and dobby hook return arm 80 are aligned with the fell line of the cloth.

As shown in FIG. 3, operating arm 40 comprises first section 42 which is oriented in a generally horizontal plane in the neutral position of the dobby apparatus and has generally rectangular cavity 43 with opposed knives 44 and 45 angularly mounted therein. Second section 52 of operating arm 40 is provided at an angle to first section 42, and is pivotally mounted between vertical framework members 33 for rotation about axis 40A. Dobby hook return arm 80 likewise comprises first section 82 which is oriented in a generally horizontal plane in the neutral position of the dobby apparatus and has suitably located cavities permitting passage of cords 48 and 58 and dobby hooks 46 and 56. Second section 83 of dobby hook return arm 80 is preferably arranged at a slight angle to first section 82, and is pivotally mounted between vertical framework members 33 for rotation about axis 80A. During the dobby operating cycle, operating arm 40 captures one dobby hook in each dobby hook pair and is pivoted downwardly, while dobby hook return arm 80 pivots upwardly with the other dobby hook in each pair. The offset angles of second section 52 of operating arm 40 and second section 83 of dobby hook return arm 80 are provided to reduce the lateral motion of operating arm 40 and dobby hook return arm 80 during the dobby operating cycle.

Pivoting of operating arm 40 during each dobby operating cycle is achieved by dobby operating arm drive mechanism 30, which is controlled by the treadles. As shown in FIGS. 1 and 2, treadles 20 and 21 are pivotable about pivot axis 22. Cords 23 and 24 are fixed to treadles 20 and 21, respectively, at ends opposite pivot axis 22, and are carried around pulleys 25 and 26, respectively, and pulleys 27 and 28, respectively, to dobby operating arm drive mechanism 30. Dobby operating arm drive mechanism 30 preferably comprises two variable ratio drive pulleys 30A and 30B receiving cords 23 and 24, respectively, and rotatable about pivot axis 29. Connecting rod 31 is pivotally mounted at one end to variable ratio drive pulleys 30A and 30B, and at the other end to operating arm 40. As variable ratio drive pulleys 30A and 30B are rotated by depression of treadles 20 and 21, respectively, they drive connecting rod 31 to raise and lower operating arm 40.

Figure 6:
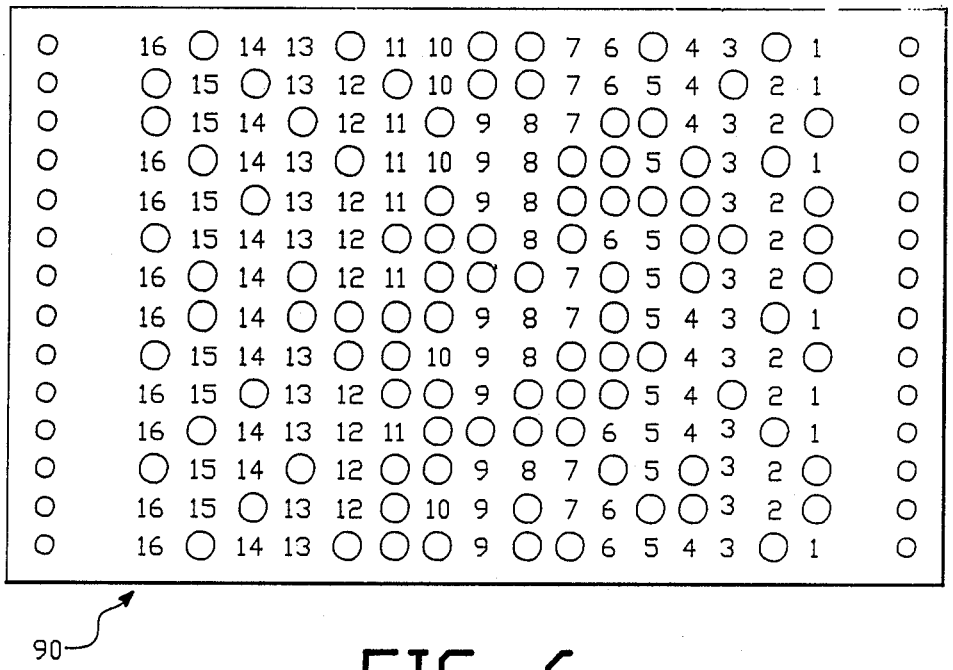
FIG. 6 shows a front view of a punched paper dobby loop encoding a predetermined weaving program for use with the dobby apparatus of the present invention.

According to one embodiment of the dobby apparatus of the present invention, a predetermined weaving program corresponding to N shaft assemblies is provided on punched paper dobby loop 90, a portion of which is shown in FIG. 6. As shown in FIG. 6, punched paper dobby loop 90 comprises a plurality of program lines, each program line corresponding to one dobby operating cycle. Each punch position on the program line, regardless of whether a hole is punched, corresponds to one of the shaft assemblies. Holes are punched in punch locations corresponding to raised shafts in the open shed position. Punched paper dobby loop 90 preferably comprises a continuous loop of paper having a plurality of program lines arranged in a predetermined weaving sequence. Each peripheral edge of punched paper dobby loop 90 is preferably provided with a plurality of spaced pin drive holes for advancing of the punched paper dobby loop by means of a tractor drive assembly.

Figure 4:
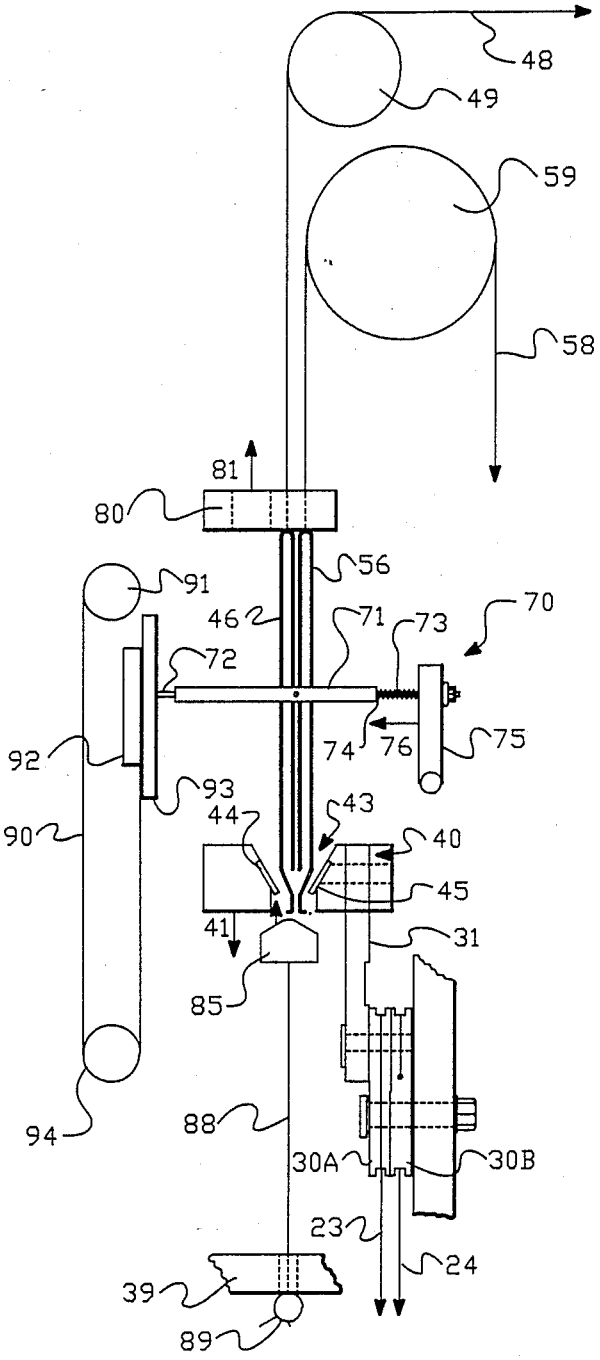
FIG. 4 shows an enlarged side view illustrating operation of the dobby apparatus with reference to a single pair of dobby hooks corresponding to a single shaft assembly.

As shown in FIG. 4, the lateral position of each dobby hook pair in generally rectangular cavity 43 of operating arm 40 at the neutral position of the dobby operating cycle determines whether the corresponding shaft will be raised or lowered in accordance with the punch positions of the predetermined weaving program. On each longitudinal side of generally rectangular cavity 43, opposed knives 44 and 45 are mounted angularly for capturing one of the dobby hooks in each pair. Dobby hook positioner assembly 70 is provided for positioning the proper dobby hook in a capture position in accordance with the predetermined weaving program.

Dobby hook positioner assembly 70 includes dobby hook positioner bar 71 having recesses therein for passage of rising and sinking dobby hooks 46 and 56, respectively. Sensing pin 72 projects from the terminal end of dobby hook positioner bar 71 aligned with the punched paper dobby loop punch position for the corresponding shaft, for sensing punched holes in punched paper dobby loop 90. Projection 73 extends from the opposite end of dobby hook positioner bar 71 and is received through dobby hook positioner paddle 75. Compression spring 74 is provided on projection 73 between positioner paddle 75 and positioner bar 71. At the neutral position of the dobby apparatus, positioner paddle 75 is pivoted forward as indicated by arrow 76, to laterally displace dobby hook positioner bar 71. Dobby hook positioner bar 71 is laterally displaceable to position sensing pin 72 between a position flush with paper drive back plate 93 and a position flush with the surface of punched paper dobby loop 90. It is an important feature of dobby hook positioner assembly 70 that the pressure of sensing pins 72 on the surface of punched paper dobby loop 90 is controlled by compression spring 74.

When sensing pin 72 detects a punched hole in punched paper dobby loop 90, it is displaced by compression spring 74 to position rising hook 46 in the capture position beneath knife 44. When sensing pin 72 detects the surface of punched paper dobby loop 90 indicating there is no punched hole, dobby hook positioner bar 71 is not displaced by compression spring 74, and sinking dobby hook 56 remains in the capture position beneath knife 45. Although a single dobby hook positioner assembly is shown in FIG. 4, it will be appreciated that N dobby hook positioner assemblies are provided corresponding to N shaft assemblies comprising the dobby apparatus. Dobby hook positioner paddle 75 preferably comprises a unitary paddle which simultaneously positions all the dobby hook positioner bars corresponding to all dobby hook pairs.

The dobby apparatus of the present invention preferably includes dobby hook capture bar 85 provided to secure the appropriate dobby hooks in their capture position during each dobby operating cycle. Dobby hook capture bar 85 is illustrated in FIGS. 3 and 4. Dobby hook capture bar 85 extends for a length slightly greater than the aligned dobby hook pairs, and is generally centered with respect thereto. Dobby hook capture bar 85 is mounted at each end to the lower surface of first section 42 of operating arm 40 by means of bolts 86, so that dobby hook capture bar 85 is not mounted directly against the lower surface of operating arm 40. Springs 87 are mounted between the head of each bolt 86 and the lower surface of dobby hook capture bar 85, and cables 88 are mounted near each bolt 86 on the lower surface of dobby hook capture bar 85. Cables 88 are received through bores in bottom crosspiece 39, and cable stops 89 are mounted on the ends of cables 88.

At the neutral position of the dobby apparatus, as illustrated in FIGS. 3 and 4, the dobby hook pairs are in a neutral transfer position, and operating arm 40 is at its uppermost position. In the neutral position, dobby hook capture bar 85 is suspended below the lower surface of operating arm 40 and below the lower surface of the dobby hook pairs to permit lateral displacement of the dobby hooks by dobby hook positioner assemblies 70. As operating arm 40 is lowered and the appropriate dobby hooks are captured by the appropriate descending knives, cables 88 become slack and springs 87 urge dobby hook capture bar 85 against the lower surface of operating arm 40 to positively retain the captured dobby hooks on the appropriate knives as the shed is opened. When the dobby apparatus is returned to its neutral position, dobby hook capture bar 85 is once again suspended from the lower surface of operating arm 40, and the dobby hooks are in a laterally displaceable, transfer position.

Figure 7:
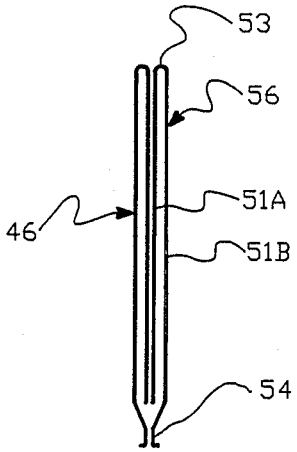
FIG. 7 shows a view of a dobby hook pair preferred for use with the dobby apparatus of the present invention.

The dobby hooks according to the present invention have a configuration which contributes significantly to the compactness and ease of operation of the dobby apparatus. As shown in FIG. 7, each dobby hook comprises two generally parallel long sections 51A and 51B connected by curved terminal end 53. Long section 51B at its end opposite curved terminal end 53 is provided with offset hook portion 54, which is aligned directly underneath long sections 51A and 51B. Offset hook portion 54 is captured by one of the knives angularly mounted in operating arm 40 during each dobby operating cycle. Each of the dobby hooks in a pair is preferably substantially identical, and the rising and sinking dobby hooks 46 and 56, respectively, in each pair are arranged with their dobby hook portions 54 adjacent and facing away from one another.

Figure 5:
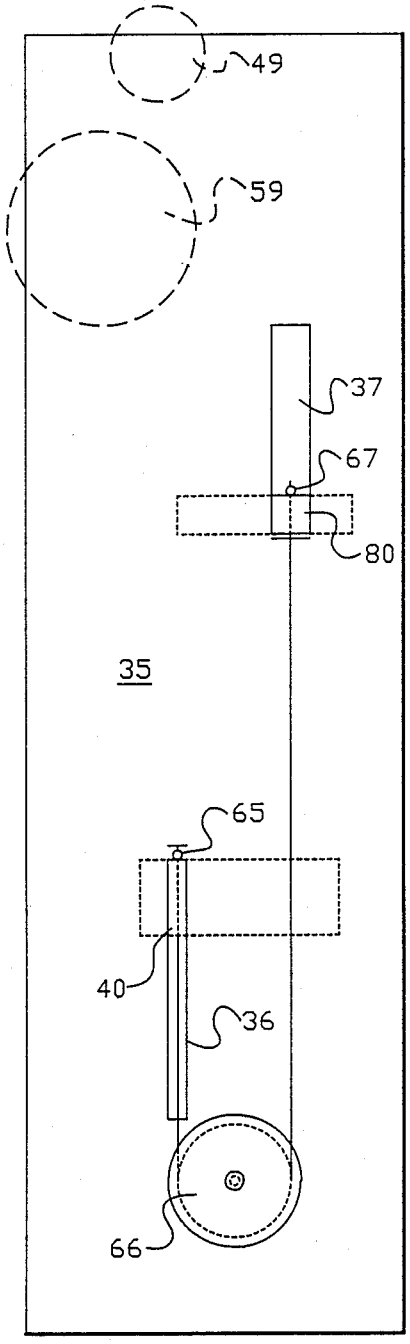
FIG. 5 shows a left side view of part of the dobby apparatus of the present invention which controls movement of the upper dobby hook return arm in response to movement of the lower operating arm.

FIG. 5 illustrates one feature of the present invention for providing that dobby hook return arm 80 is consistently and securely positioned at the bottom of tang guide slot 37 during each dobby operating cycle to align each of the dobby hook pairs in the neutral transfer position. Cable 64 is passed through operating arm 40 and anchored therein by cable termination end stop 65. In the neutral, rest position shown in FIG. 5, cable 64 traverses tang guide slot 36 and passes around pulley 66, through dobby hook return arm 80, and is anchored therein by cable termination end stop 67. when operating arm 40 is in the neutral position and the dobby hook pairs are in the transfer position, this arrangement ensures that dobby hook return arm 80 is securely seated against the bottom of tang guide slot 37 to positively position and align the dobby hook pairs in the transfer position. When operating arm 40 is in the open shed position at the bottom of tang guide slot 36 during the dobby operating cycle, dobby hook return arm 80 is raised in tang guide slot 37, and cable 64 preferably has some slack. Adjustment means such as a turnbuckle or the like may also be provided on cable 64 to provide fine adjustment of the cable length. In operation, the pulley 66 acts to reverse the cable 64 direction, so that the return arm 80 is pulled toward the operating arm 40 a sufficient distance so that the hooks clear the knives for transfer.

Figure 9:
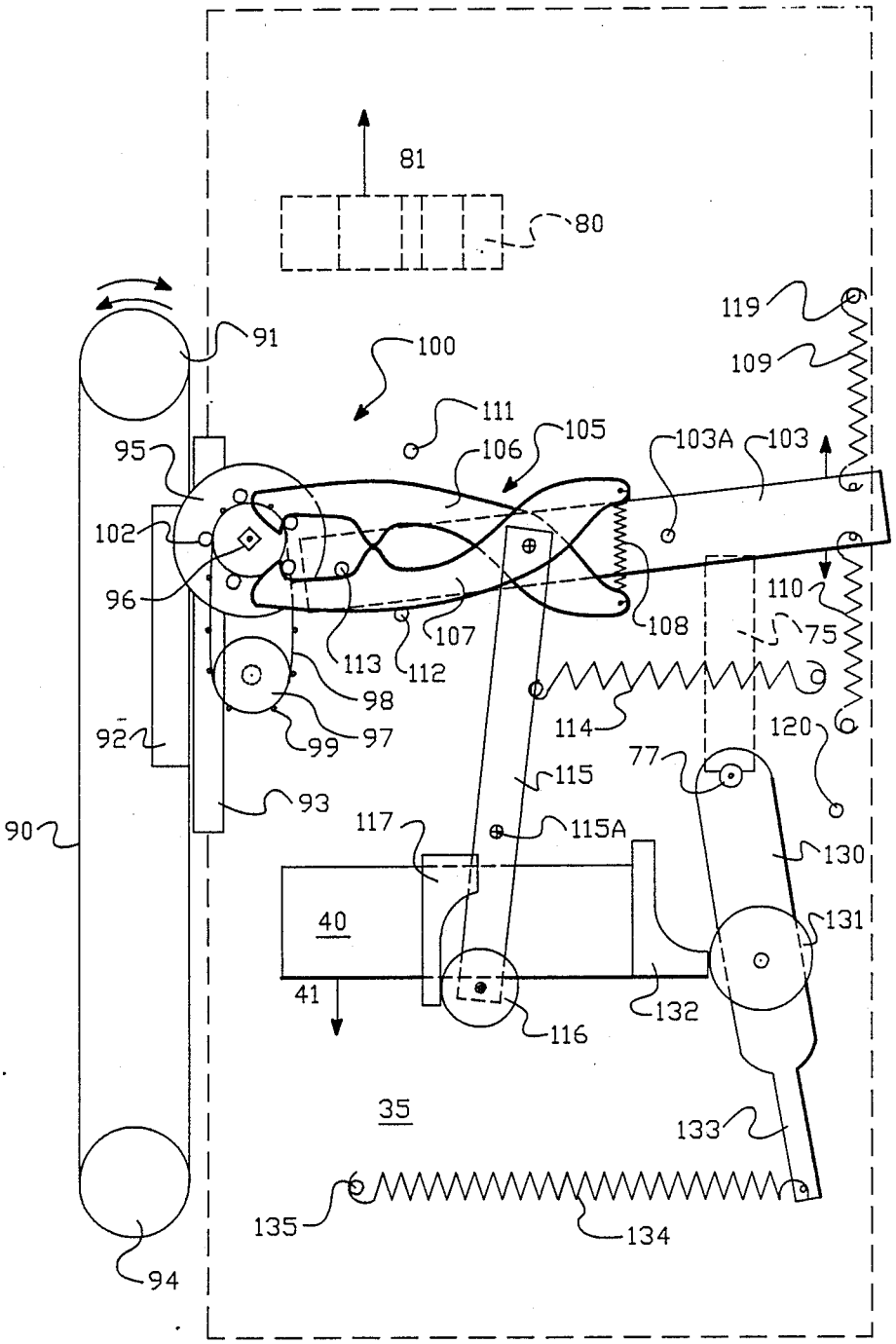
FIG. 9 shows a side view of the dobby program drive assembly forming part of the dobby apparatus of the present invention in a locked position.

FIG. 9 illustrates punched paper dobby loop 90 mounted on upper guide roller 91 positioned between paper gate 92 and paper drive back plate 93. Paper guide roller 91 is rotatably suspended from mounting brackets mounted on vertical supports 34 and 35 of the dobby apparatus framework. Lower roller weight 94 is preferably provided to maintain punched paper dobby loop in a somewhat taut condition. Paper drive back plate 93 comprises a flat plate extending the distance between vertical supports 34 and 35 and having spaced holes drilled therein corresponding to the punch positions on each program line of punched paper dobby loop 90. Sensing pins 72 mounted at the terminal end of each dobby hook positioner bar 71 are aligned with and retained in spaced holes in paper drive back plate 93. Paper gate 92 likewise extends between vertical supports 34 and 35 and is provided with spaced holes corresponding to those in paper drive back plate 93.

With each dobby operating cycle, punched paper dobby loop 90 is advanced one program line in a forward or reverse direction. A preferred punched paper dobby loop advanced assembly is illustrated in FIG. 9. Tractor guide assemblies comprising tractor indexing wheel 95 mounted for rotation on central, non-round shaft 96, and tractor axle 97 are preferably mounted to vertical supports 34 and 35 in proximity to each peripheral edge of punched paper dobby loop 90 for advancing the dobby loop in a forward or reverse direction. Drive tractor belts 98 having a plurality of drive pins 99 extending therefrom are mounted around each tractor indexing wheel 95 and tractor axle 97. Drive pins 99 are spaced at intervals corresponding to the spaced apertures in punched paper dobby loop 90. As tractor indexing wheel 95 and drive shaft 96 is rotated, the drive pins adjacent punched paper dobby loop 90 catch in the spaced apertures to advance the dobby loop in a forward or reverse direction.

Although tractor guide assemblies are preferably mounted to both vertical supports 34 and 35 in proximity to both peripheral edges of punched paper dobby loop 90, a single dobby program drive assembly 100 is preferably mounted on intermediate vertical support 35, as shown in FIG. 9. Tractor indexing wheel 95 has a plurality of radially arranged drive pins 102 projecting substantially perpendicularly therefrom. Tractor indexing clamp means 105 is mounted on paper indexing operating arm 115 for engaging pins 102 to advance the tractor indexing wheel in a forward or reverse direction. Tractor indexing clamp means 105 includes two opposed jaws 106 and 107 having spring 108 extending between the opposed inner ends of the jaw members. Top and bottom stop pins 111 and 112, respectively, are mounted on intermediate vertical support 35 of the dobby framework, while control pin 113 is mounted on paper drive direction lever 103. Paper drive direction lever 103 is mounted for rotation about pivot axis 103A on intermediate vertical support 35.

Paper indexing operating arm 115 is pivotaly mounted on intermediate vertical support 35 for rotation about pivot axis 115A. Paper indexing cam roller 116 is rotatably mounted at the end of paper indexing operating arm 115, and interacts with paper indexing cam 117 rigidly mounted on operating arm 40. As operating arm 40 is moved downward during the dobby operating cycle, paper indexing cam roller 116 travels along paper indexing cam 117, paper indexing arm 115 is rotated about axis 115A and urges tractor indexing clamp means 105 forward toward the tractor guide assembly. As paper tractor indexing clamp means 105 is urged forward, the hook ends of opposed jaws 106 and 107 are disengaged from drive pins 102.

Figure 10:
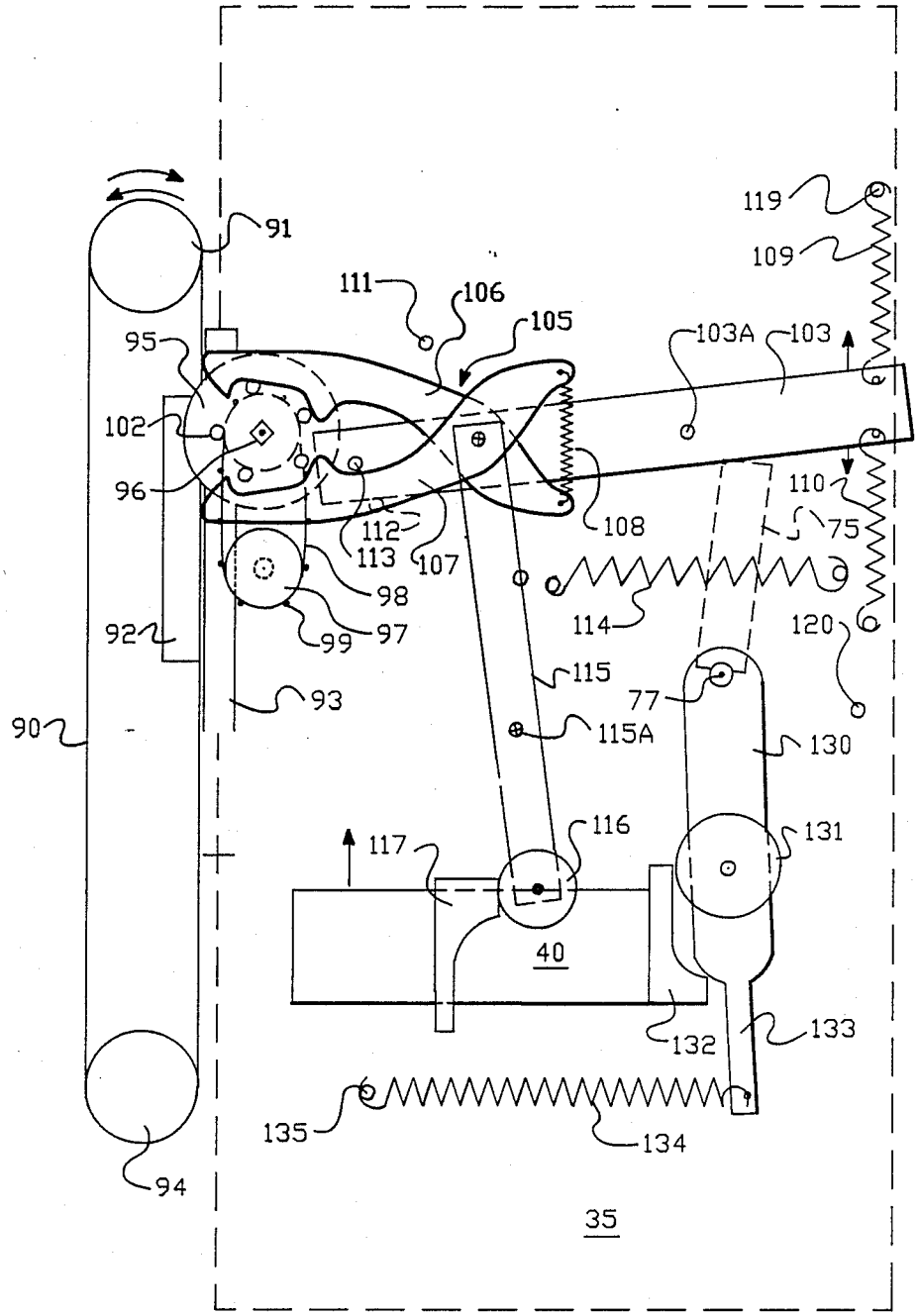
FIG. 10 shows a side view of the dobby program drive assembly of FIG. 9 in an open, advance position.

With paper drive direction lever 103 in the position shown in FIG. 9, as lower jaw 107 is urged forward by paper indexing operating arm 115, stop pin 113 travels along its inner contour. Due to the contour of the inner surface of jaws 107, the lower jaw is urged downwardly as it travels forward and is positioned to miss an adjacent drive pin 102. The upper jaw slides over and engages the next adjacent drive pin to advance tractor indexing wheel 95 in the clockwise direction when paper indexing operating arm 115 is pivoted. This positioned of tractor indexing clamp means 105 is illustrated in FIG. 10 and corresponds to the bottom position of operating arm 40 during the dobby operating cycle.

As operating arm 40 returns to its uppermost, neutral position, paper indexing operating arm 115 is again pivoted about axis 115A by the interaction of cam roller 116 with cam 117 to urge tractor indexing clamp means 105 back. This motion urges opposed jaws 106 and 107 toward one another, and upper jaw 106 engages the next adjacent drive pin 102 to rotate tractor indexing wheel 95 a distance corresponding to the interval between program lines on punched paper dobby loop 90 to position a new program line in the reading position. As shown in FIG. 9, tractor indexing wheel 95 is locked in the neutral position be engagement of adjacent drive pins 102 in opposed jaw members 106 and 107. Paper indexing operating arm 115 is stabilized in a neutral position by spring means 114.

Paper drive direction lever 103 is adjustable to provide rotation of tractor indexing wheel 95 in a forward or reverse direction. Adjustment of paper drive direction lever 103 may be accomplished by mounting spring means 109 and 110 in proximity to the upper and lower edges at the inner end of paper drive direction lever 103, and mounting spring attachment pins 119 and 120 on vertical support 35 for engaging springs 109 and 110, respectively. Upper spring 109 is engaged with upper spring attachment pin 119 for driving tractor indexing wheel 95 in a forward direction. Engagement of upper spring 109 pivots paper drive direction lever 103 about pivot axis 103A, until it is stopped by contact with forward direction stop pin 112. Control pin 113 is in contact with the inner surface of lower jaw 107, and the lower jaw is manipulated to miss the next adjacent drive pin on tractor indexing wheel 95 to drive punched paper dobby loop 90 in a forward direction. Conversely, engagement of lower spring 110 with lower spring attachment pin 120 pivots paper drive direction lever 103 about pivot axis 103A until it is stopped by contact with reverse direction stop pin 111. Control pin 113 is then in contact with the inner surface of upper jaw 106, and the upper jaw is manipulated to miss the next adjacent drive pin on tractor indexing wheel 95. In this position, lower jaw 107 engages the next adjacent drive pin to drive punched paper dobby loop 90 in a reverse direction.

Figure 8:
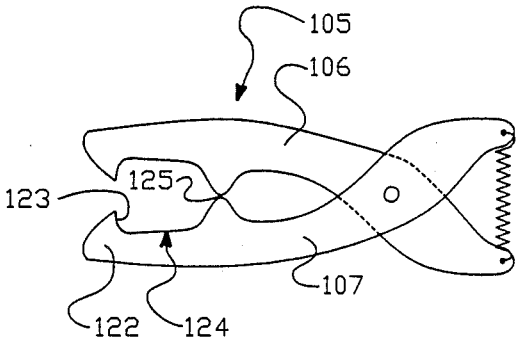
FIG. 8 illustrates a preferred embodiment of jaw members forming the tractor indexing clamp means according to the present invention.

The contour of jaws members 106 and 107 comprising tractor indexing clamp means 105 is important to provide functional operation of dobby program drive assembly 100. As shown in FIG. 8, each jaw member comprises hook portion 122 at one end having an inwardly directed, curved engagement surface 123 for releasably engaging a drive pin. Inner operating surface 124 includes a relatively flat portion adjacent curved engagement surface 123, and a curved portion which terminates in shoulder 125. The curved portion represents the travel path for control pin 113 to position curved engagement surface 123 to miss the next adjacent drive pin as the opposed jaw members are urged forward during the dobby operating cycle. The rear portions of jaw members 106 and 107 are curved so that they may be fastened by spring means 108 to provide tension urging hook portions 122 toward one another.

FIG. 9 also iillustrates the drive mechanism for positioning dobby hook positioner paddle 75 during each dobby operating cycle. A lower end of dobby hook positioner paddle 75 is mounted on shaft 77, which is mounted at an upper end of positioner paddle operating arm 130. Positioner paddle operating arm 130 is provided with rotatable positioner roller 131 at an opposite end thereof for interaction with positioner paddle cam 132 mounted on operating arm 40. The positioner paddle operating arm is also provided with extension 133, which has spring 134 mounted at its terminal end and attached to spring attachment pin 135 to cause rotatable positioner roller 131 to follow positioner paddle cam 132. As operating arm 40 is lowered during the dobby operating cycle, positioner roller 131 travels along positioner paddle cam 132, which pivots the upper edge of dobby hook positioner paddle 75 forward. As operating arm 40 is raised to its neutral position, positioner roller 131 is returned to its neutral position, and the upper edge of dobby hook positioner paddle 75 is returned to its upright, neutral position.

The dobby apparatus of the present invention is preferably additionally provided with a shaft balancing means to reduce the effort required to position a plurality of shafts 15 in an open shed position and return the shafts to a neutral position aligned with the center line of the wrap. Without the shaft balancing means of the present invention, the loom operator must lift and lower the shafts directly through increased pressure on the treadles. The shaft balancing means of the present invention is illustrated in FIGS. 1 and 2, and includes constant tension devices 140 mounted between shaft balancer anchor bar 141 provided on the dobby apparatus framework and each double cord 48 extending between pulleys 49 and 50. A constant tension device 140 is provided for each double cord 48 corresponding to each dobby hook pair and each shaft to balance the shaft assemblies in the neutral position. According to a preferred embodiment, rubber bands may be provided as constant tension device 140.

Figure 11:
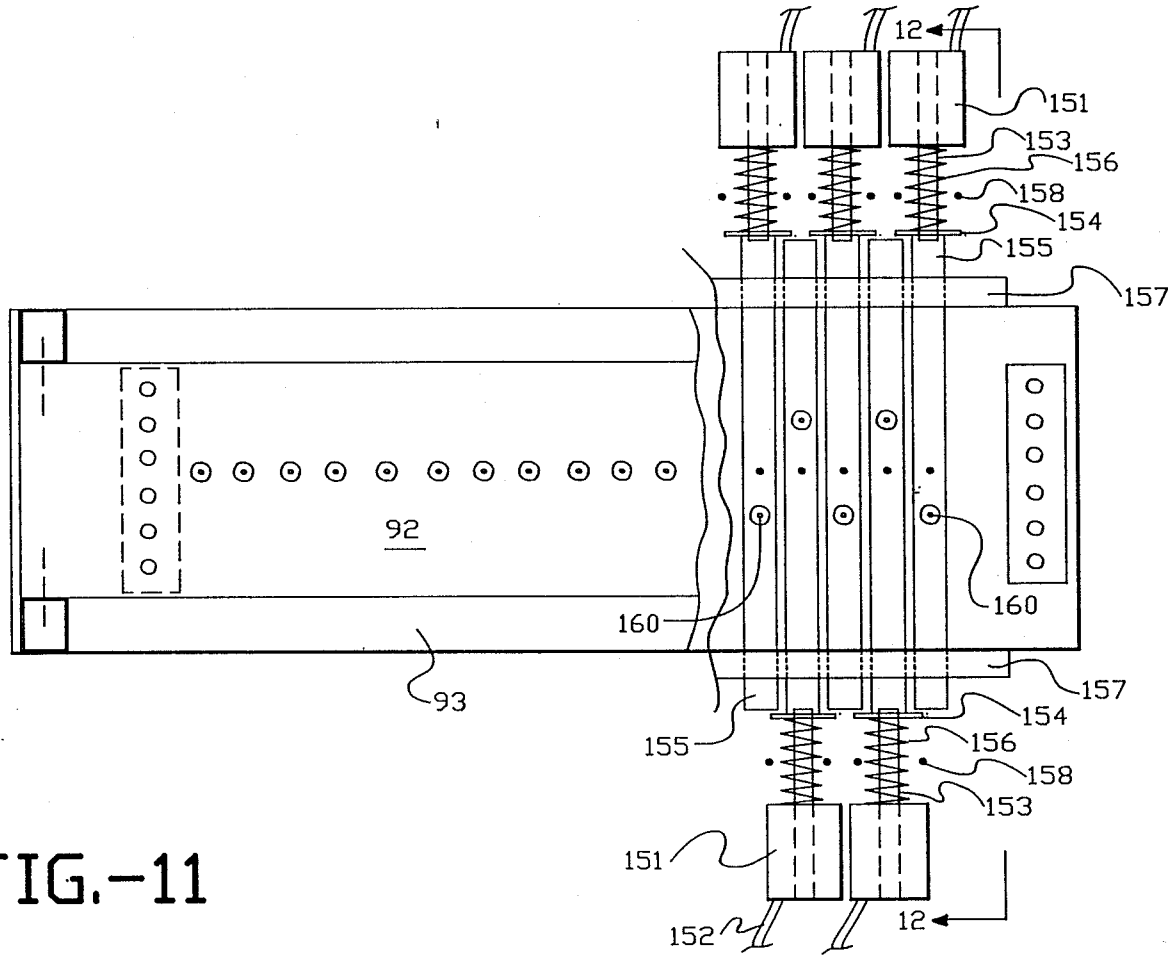
FIG. 11 shows a front view of a solenoid operated computer interface drive providing a direct operating linkage between an electronic operating mechanism and the dobby apparatus of the present invention.
Figure 12:
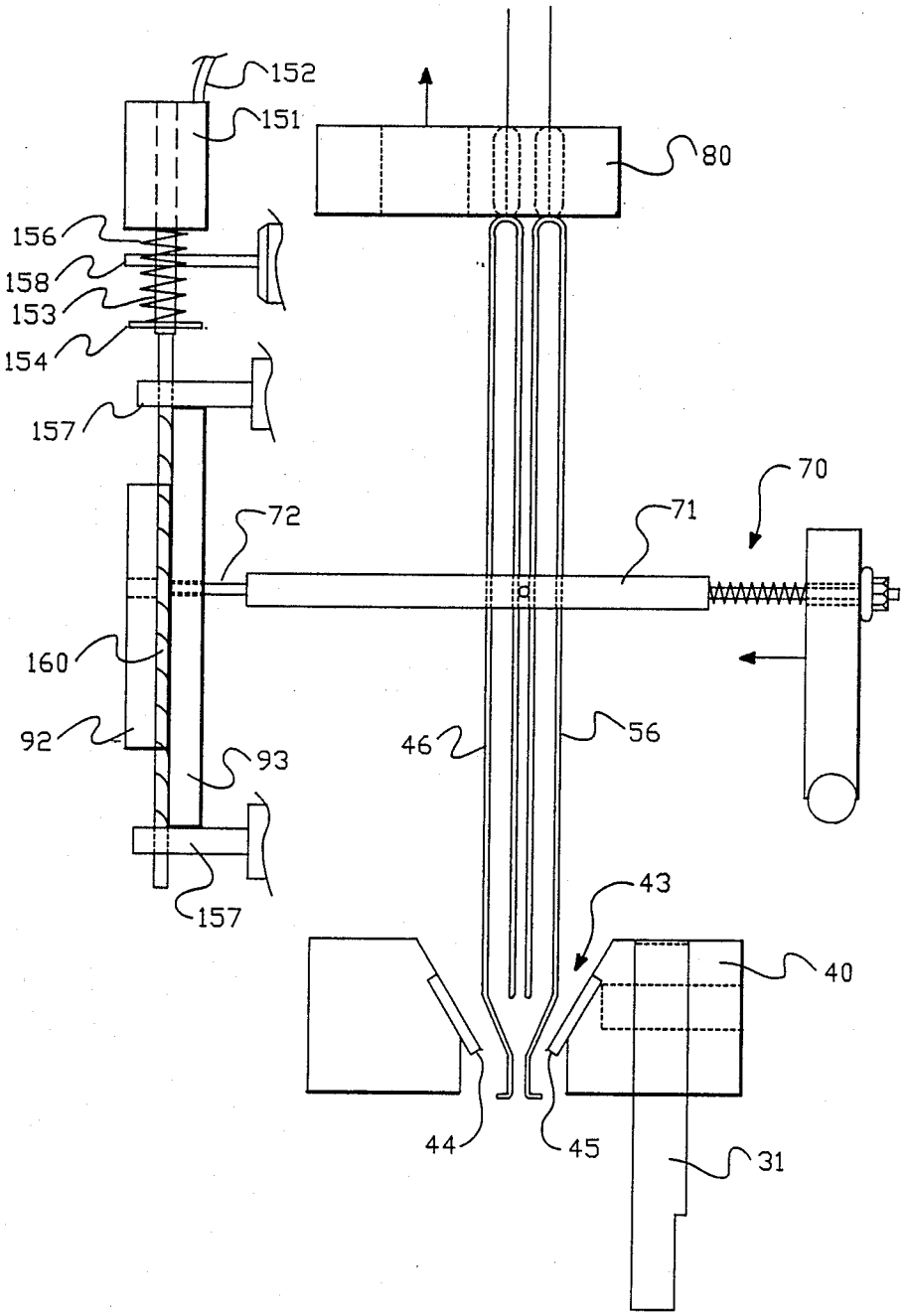
FIG. 12 shows a side view taken substantially along line 12—12 of FIG. 10, illustrating a single solenoid slider assembly corresponding to a single shaft assembly of the dobby apparatus of the present invention.

FIGS. 11 and 12 illustrate another preferred embodiment of the dobby apparatus of the present invention having a solenoid operated computer interface drive receiving weaving pattern information from appropriate design software, which is known in the art and is commercially available. Solenoid operated computer interface drive assembly 150 responsive to electrical signals is substituted for punched paper dobby loop 90. The operating principles of the dobby apparatus incorporating solenoid operated computer interface drive assembly 150 are identical to those described previously, in that sensing pins 72 of dobby hook positioner assemblies 70 detect the presence or absence of an aperture according to a predetermined weaving program to laterally position each dobby hook pair. Rather than detecting punched holes in a punched paper dobby loop, however, solenoid operated computer interface drive assembly 150 aligns slider sensing pin holes at or offset from the sensing pin position in response to electrical signals.

As shown in FIGS. 11 and 12, a solenoid 151 having a solenoid slider 155 attached thereto is provided corresponding to each shaft assembly in the dobby apparatus. Each solenoid 151 is electrically connected to a computer apparatus or the like through solenoid coil wires 152. One solenoid slider 155 is vertically mounted between paper drive backplate 93 and paper gate 92, directly over the sensing pin location for each dobby hook positioner assembly 70. Solenoid sliders 155 are received through slots in solenoid slider guide plates 157 mounted at the top and bottom of paper drive back plate 93 and are maintained in vertical alignment thereby. Solenoid sliders 155 are preventing from flexing or buckling by contact with paperdrive backplate 93 and upper gate 92.

Solenoids 151 are rigidly mounted on brackets on the dobby framework to assure accurate alignment of solenoid sliders 155. Solenoid sliders 155 are preferably mounted to solenoids 151 by means of solenoid plungers 153 having solenoid plunger stop collars 154 mounted at the interface of solenoid plungers 153 with solenoid sliders 155. Compression springs 156 are mounted on solenoid plungers 153 between solenoid 151 and solenoid plunger stop collars 154. As illustrated in FIG. 11, solenoids corresponding to adjacent punch positions are preferably mounted on opposite sides of paper gate 92 and paper drive back plate 93.

Each solenoid slider 155 is provided with a slider sensing aperture 160 therein. Solenoid sliders 155 are moved up or down, depending on the location of the solenoid, to align solenoid slider sensing aperture 160 with sensing pin clearance holes in paper gate 92 to permit passage of sensing pin 72 to provide lateral adjustment of dobby hook positioner bar 71 and position rising hook 46 in the capture position. When the solenoid is not energized, solenoid slider 155 covers the sensing pin hole in paper drive back plate 93, the sensing pin and dobby hook positioner bar are not laterally displaced, and the sinking dobby hook is engaged by operating arm 40. When the solenoid is activated, solenoid slider 155 is moved toward the solenoid as solenoid plunger 153 is drawn into the solenoid. Vertical movement of solenoid slider 155 is stopped by contact of solenoid plunger stop coller 154 with solenoid plunger stop means 158. Movement of solenoid slider 155 is stopped when solenoid slider sensing aperture 160 is aligned with the sensing pin of dobby hook positioner assembly 70. The dobby hook positioner bar and sensing pin are laterally displaced to position the rising dobby hook in the capture position. Slider sensing apertures 160 thus function in exactly the same fashion as punched holes in punched paper dobby loop 90 to control lateral positioning of dobby hook positioner bar 71 and capture of one of the dobby hooks in each pair.

After the sensing pins are withdrawn from solenoid slider sensing apertures 160, the computer program deactivates solenoid 151, and compression springs 156 return solenoid plungers 153 and sliders 155 to their deenergized positions awaiting the next design command from the computer software. A dobby sequence timing microswitch is provided to relay timing information to the computer for timing activation and deactivation of the solenoids in accordance with the dobby operating cycle.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A dobby apparatus for use with hand looms for automatically controlling the lifting sequence of a plurality of shafts comprising:

a dobby operating drive mechanism connected to a dobby operating arm for pivoting said dobby operating arm downwardly from a neutral position and returning it to said neutral position during each dobby operating cycle;

a plurality of dobby hook pairs mounted in a transfer position when said dobby operating arm is in said neutral position, each of said plurality of dobby hook pairs being connected to a different one of said plurality of shafts;

a plurality of dobby hook positioner assemblies contacting said dobby hook pairs to laterally transfer both of said dobby hooks in each of said pairs between a first capture position in which a first dobby hook in each of said dobby hook pairs is engageable in said dobby operating arm and a second capture position in which a second dobby hook in each of said dobby hook pairs is engageable in said dobby operating arm; and a dobby program drive assembly in operative engagement with said dobby hook positioner assemblies to control lateral displacement of said dobby hook positioner assemblies in accordance with a predetermined weaving program;

the dobby hooks of said plurality of dobby hook pairs each having two generally parallel sections connected by a terminal end and a hook portion extending from one of the parallel sections, offset toward the other of the parallel sections and aligned directly beneath the parallel sections, each of the dobby hooks being connected to one of said plurality of shafts from the terminal end, each of said dobby hook pairs being connected to one of said plurality of shafts with flexible cord, a biasing means being connected to the flexible cord to pull on the flexible cord in a direction opposite to a direction of pull by the weight of the one of said plurality of shafts on the flexible cord, thus to balance the weight of the one of said plurality of shafts.

2. The dobby apparatus of claim 1 additionally comprising means for forcing the dobby hooks of said plurality of dobby hook pairs into position for clearance from the capture positions to permit transfer between the capture positions.

3. A dobby apparatus for use with hand looms for automatically controlling the lifting sequence of a plurality of shafts comprising:

a dobby operating drive mechanism connected to a dobby operating arm for pivoting said dobby operating arm downwardly from a neutral position and returning it to said neutral position during each dobby operating cycle;

a plurality of dobby hook pairs mounted in a transfer position when said dobby operating arm is in said neutral position, each of said plurality of dobby hook pairs being connected to a different one of said plurality of shafts;

a plurality of dobby hook positioner assemblies contacting said dobby hook pairs to laterally transfer both of said dobby hooks in each of said pairs between a first capture position which a first dobby hook in each of said dobby hook pairs is engageable in said dobby operating arm and a second capture position in which a second dobby hook in each of said dobby hook pairs is engageable in said dobby operaing arm;

a dobby program drive assembly in operative engagement with said dobby hook positioner assemblies to control lateral displacement of said dobby hook positioner assemblies in accordance with a predetermined weaving program;

a means for forcing the dobby hooks of said plurality of dobby hook pairs into position for clearance from the capture positions to permit transfer between the first and second capture positions;

the dobby hooks of said plurality of dobby hook pairs each having two generally parallel sections connected by a terminal end and a hook portion extending from one of the parallel sections, offset toward the other of the parallel sections and aligned directly beneath the parallel sections, each of the dobby hooks being connected to one of said plurality of shafts from the terminal end, each of said dobby hook pairs being connected to one of said plurality of shafts with flexible cord; and a hook return arm positioned to restrain ones of the hooks of said plurality of dobby hook pairs that are free of capture, said means for forcing being a cable connected over a reversing pulley between said operating arm and said hock return arm.

4. The dobby apparatus of claim 3 in which said dobby program drive assembly includes a looped member having a plurality of apertures defining the weaving program.

5. The dobby apparatus of claim 4 in which said dobby program drive assembly includes a drive means connected to the looped member, an indexing and position locking means connected to the drive means, and a forward and reverse control means connected to the indexing and position locking means.

6. The dobby apparatus of claim 5 in which said drive means comprises a tractor feed having a first set of drive pins engaging the looped member and a second set of drive pins substantially perpendicular to the first set of drive pins and engaging said indexing and position locking means, said indexing and position locking means comprising a clamp having a pair of pivotably movable jaws positioned to enage pairs of the second set of drive pins with said clamp in a first position and to disengage the pairs of the second set of drive pins with said clamp in a second position, said clamp being mounted for reciprocal motion between the first position and the second position, and means for pivoting one of the movable jaws out of orientation for engaging the second set of drive pins when said clamp is moved from the first position to the second position, and for pivoting the one of the moveable jaws back into orientation for engaging the second set of drive pins when said clamp is moved from the second position to the first position to index said drive means.

7. The dobby apparatus of claim 6 in which said means for pivoting is movable from the one of the movable jaws to the other of the movable jaws for reversing drive direction of said tractor feed.

8. The dobby apparatus of claim 7 additionally comprising a capture bar positioned on and substantially parallel to said dobby operating arm, biasing means connected to said capture bar to urge said capture bar against said dobby operating arm to keep ones of the hooks in said hook pairs captured by said dobby operating arm in the captured position, and means for holding said capture bar away from said dobby operating arm when said dobby operating arm is in the neutral position.

9. The dobby apparatus of claim 8 in which said means for holding said capture bar away from said dobby operating arm comprises a pair of cables extending downward from said capture bar, said pair of cables having a length such that they are taut when said dobby operating arm is in the neutral position, and such that they are slack when said dobby operating arm is moved downward, thus allowing said biasing means to urge said capture bar against said dobby operating arm.

10. A dobby apparatus for use with hand looms for automatically controlling the lifting sequence of a plurality of shafts comprising:

a dobby operating drive mechanism connected to a dobby operating arm for pivoting said dobby operating arm downwardly from a neutral position and returning it to said neutral position during each dobby operating cycle;

a plurality of dobby hook pairs mounted in a transfer position when said dobby operating arm is in said neutral position, each of said plurality of dobby hook pairs being connected to a different one of said plurality of shafts with a flexible cord;

a plurality of dobby hook positioner assemblies contacting said dobby hook pairs to laterally transfer both of said dobby hooks in each of said pairs between a first capture position in which a first dobby hook in each of said dobby hook pairs is engageable in said dobby operating arm and a second capture position in which a second dobby hook in each of said dobby hook pairs is engageable in said dobby operating arm;

a dobby program drive assembly in operative engagement with said dobby hook positioner assemblies to control lateral displacement of said dobby hook positioner assemblies in acccordance with a predetermined weaving program;

means for forcing the dobby hooks of said plurality of dobby hook pairs into position for clearance from the capture positions to permit transfer between the capture positions; and a hook return arm positioned to restrain ones of the hooks of said plurality of dobby hook pairs that are free of capture, said means for forcing being a cable connected over a reversing pulley between said operating arm and said hook return arm.

11. A dobby apparatus for use with hand looms for automatically controlling the lifting sequence of a plurality of shafts comprising:

a dobby operating drive mechanism connected to a dobby operating arm for pivoting said doby operating arm downwardly from a neutral position and returning it to said neutral position during each dobby operating cycle;

a plurality of dobby hook pairs mounted in a transfer position when said dobby operating arm is in said neutral position, each of said plurality of dobby hook pairs being connected to a different one of said plurality of shafts with a flexible cord;

a plurality of dobby hook positioner assemblies contacting said dobby hook pairs to laterally transfer both of said dobby hooks in each of said pairs between a first capture position in which a first dobby hook in each of said dobby hook pairs is engageable in said dobby operating arm and a second capture position in which a second dobby hook in each of said dobby hook pairs is engageable in said dobby operating arm;

a dobby program drive assembly in operative engagement with said dobby hook positioner assemblies to control lateral displacement of said dobby hook positioner assemblies in accordance with a predetermined weaving program; and a biasing means connected to the flexible cord to pull on the flexible cord in a direction opposite to a direction of pull by the weight of the one of said plurality of shafts on the flexible cord, thus to balance the weight of the one of said plurality of shafts.

12. The dobby apparatus of claim 11 in which said biasing means comprises a.

13. A dobby apparatus for use with hand looms for automatically controlling the lifting sequence of a plurality of shafts comprising:

a dobby operating drive mechanism connected to a dobby operating arm for pivoting said dobby operating arm downwardly from a neutral position and returning it to said neutral position during each dobby operating cycle;

a plurality of dobby hook pairs mounted in a transfer position when said dobby operating arm is in said neutral position, each of said plurality of dobby hook pairs being connected to a different one of said plurality of shafts with a flexible cord;

a plurality of dobby hook positioner assemblies contacting said dobby hook pairs to laterally transfer both of said dobby hooks in each of said pairs between a first capture position in which a first dobby hook in each of dobby hook pairs is engageable in said dobby operating arm and a second capture position in which a second dobby hook in each of said dobby hook pairs is engageable in said dobby operating arm;

a dobby program drive assembly in operative engagement with said dobby hook positioner assemblies to control lateral displacement of said dobby hook positioner assemblies in accordance with a predetermined weaving program, said dobby program drive assembly including a looped member having a plurality of apertures defining the weaving program, a drive means connected to the looper member, an indexing and position locking means connected to the drive means, and a forward and reverse control means connected to the indexing and position locking means, said drive means comprising a tractor feed having a first set of drive pins engaging the looped member and a second set of drive pins substantially perpendicular to the first set of drive pins and engaging said indexing and position locking means, said indexing and positioning locking means comprising a clamp having a pair of pivotally movable jaws positioned to engage pairs of the second set of drive pins with said clamp in first position and to disengage the pairs of the second set of drive pins with said clamp in a second position, said clamp being mounted for reciprocal motion between the first position and the second position, and means for pivoting one of the movable jaws out of orientation for engaging the second set of drive pins when said clamp is moved from the first position to the second position, and for pivoting the one of the movable jaws back into orientation for engaging the second set of drive pins when said clamp is moved from the second position to the first position to index said drive means.

14. A dobby apparatus for use with hand looms for automatically controlling the lifting sequence of a plurality of shafts comprising:

a dobby operating drive mechanism connected to a dobby operating arm for pivoting said dobby operating arm downwardly from a neutral position and returning it to said neutral position during each dobby operating cycle;

a plurality of dobby hook pairs mounted in a transfer position when said dobby operating arm is in said neutral position, each of said plurality of dobby hook pairs being connected to a different one of said plurality of shafts with a flexible cord;

a plurality of dobby hook positioner assemblies contacting said dobby hook pairs to laterally transfer both of said dobby hooks in each of said pairs between a first capture position in which a first dobby hook in each of said dobby hook in pairs is engageable in said dobby operating arm and a second capture position in which a second dobby hook in each of said dobby hook pairs is engageable in said dobby operating arm;

a dobby program drive assembly in operative engagement with said dobby hook positioner assemblies to control lateral displacement of said dobby hook positioner assemblies in accordance with a predetermined weaving program;

a capture bar positioned on and substantially parallel to said dobby operating arm;

biasing means connected to said capture bar to urge said capture bar against said dobby operating arm to keep ones of the hooks in said hook pairs captured by said dobby operating arm in the captured position; and means for holding said capture bar away from said dobby operating arm when said dobby operating arm is in the neutral position, said means for holding said capture bar away from said dobby operating arm comprising a pair of cables extending downward from said capture bar, said pair of cables having a length such that they are taut when said dobby operating arm is in the neutral position, and such that they are slack when said dobby operating arm is moved downward, thus allowing said biasing means to urge said capture bar against said dobby operating arm.

* * * * *